US007277652B2

(12) United States Patent
Kubo

(10) Patent No.: US 7,277,652 B2
(45) Date of Patent: Oct. 2, 2007

(54) IMAGE-FORMING DEVICE THAT ELIMINATES NOISE FROM A TEMPERATURE DETECTION SIGNAL

(75) Inventor: Isao Kubo, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 192 days.

(21) Appl. No.: 11/139,598

(22) Filed: May 31, 2005

(65) Prior Publication Data

US 2005/0265743 A1 Dec. 1, 2005

(30) Foreign Application Priority Data

May 31, 2004 (JP) ..... 2004-162396

(51) Int. Cl.
*G03G 15/20* (2006.01)
*G03G 15/00* (2006.01)

(52) U.S. Cl. ..... 399/69; 399/44; 399/37

(58) Field of Classification Search ..... 399/44, 399/67, 69, 88, 37; 219/216
See application file for complete search history.

(56) References Cited

U.S. PATENT DOCUMENTS 5,942,882 A * 8/1999 Ohta ..... 323/282

FOREIGN PATENT DOCUMENTS

| | | |
|---|---|---|
| JP | 6-005434 B2 | 1/1994 |
| JP | 8-262679 A | 10/1996 |
| JP | 10-307514 A | 11/1998 |
| JP | 11-073058 A | 3/1999 |

* cited by examiner

*Primary Examiner*—Hoang Ngo
(74) *Attorney, Agent, or Firm*—Oliff & Berridge, PLC

(57) ABSTRACT

A laser printer capable of controlling the operation of a fixing heater to heat a roller, including an energizing circuit for energizing a heater, a temperature detecting circuit such as thermistors, a noise canceling circuit, and a control circuit for controlling the energizing circuit and the heater. After receiving a voltage indicating an abnormal temperature of the heater over a prescribed length of time duration, the noise canceling circuit is configured to transmit a LOW level voltage to a latch circuit as an abnormality signal. The control circuit suspends the energization of the heater in response to the abnormality signal.

9 Claims, 10 Drawing Sheets

IMAGE-FORMING DEVICE THAT ELIMINATES NOISE FROM A TEMPERATURE DETECTION SIGNAL

BACKGROUND OF THE INVENTION

1. Field of the Invention

The present invention relates to an image-forming device, and particularly to a mechanism for controlling a fixing heater in the image-forming device.

2. Related Art

An image-forming device generally includes a fixing unit for fixing a toner image to a recording medium after the image has been transferred thereon. The fixing unit is configured of a fixing roller including a fixing heater inside, and a pressure roller that contacts the fixing roller with pressure. The recording medium is pinched between and conveyed by the fixing roller and pressure roller with the surface of the recording medium with the toner image facing the fixing roller. The heat from the fixing roller melts and fixes the toner image to the recording medium.

However, the fixing heater sometimes happens to reach an excess high temperature due to any unexpected reasons. Japanese patent application publication No. HEI 10-307514 discloses an image-forming device which cuts off electric power fed to the fixing heater when the temperature of the heater exceeds a predetermined level. Therefore, the fixing unit is protected from overheat.

One attempt to protect the fixing unit from overheat is to control the fixing heater according to a software program when the temperature of the fixing heater reaches an unusual level. However, such a software process is not as reliable since the software may happen to be out of control. On the other hand, one may control the temperature of the fixing unit by a hardware configuration. However, a problem may arise that the hardware configuration may malfunction.

SUMMARY

In view of the foregoing, it is an object of the present invention to provide an image-forming device controls the fixing heater with high reliability, while suppressing the effects of noise, even when the control mechanism is configured in hardware.

The present invention provides an image-forming device having: a fixing heater, an energizing unit, a temperature detecting unit, a noise canceling unit, and a control unit. The fixing heater heats a roller to fix a toner image transferred on a recording medium. The energizing unit energizes the fixing heater. The temperature detecting unit detects a temperature of the roller to generate a detection signal having a level corresponding to the detected temperature. The noise canceling unit eliminates a noise component from the detection signal to generate a resulting signal. The control unit generates a control signal for controlling the energizing unit, according to the resulting signal from the noise canceling unit.

The present invention provides an image-forming device having: a fixing heater, a temperature detecting unit, a noise canceling unit, and a control unit. The fixing heater heats a roller to fix a toner image transferred on a recording medium. The temperature detecting unit detects a temperature of the roller to generate a detection signal having a level corresponding to the detected temperature. The noise canceling unit determines at prescribed time-intervals if the level of the detection signal exceeds a prescribed level corresponding to an abnormal temperature level. The noise canceling unit starts counting a number of timing on which the level of the detection signal exceeds the prescribed level, after the noise canceling unit determines for a first time that the level of the detection signal exceeds the prescribed level. The noise canceling unit generates an abnormality signal when the number of timing reaches a prescribed number. The control unit generates a control signal for controlling the fixing heater. The control unit suspends energization of the fixing heater when the noise canceling unit generates the abnormality signal.

BRIEF DESCRIPTION OF THE DRAWINGS

The above and other objects, features, and advantages of the invention will become more apparent from reading the following description of the preferred embodiments taken in connection with the accompanying drawings in which.

DESCRIPTION OF THE EMBODIMENTS

Figure 1:
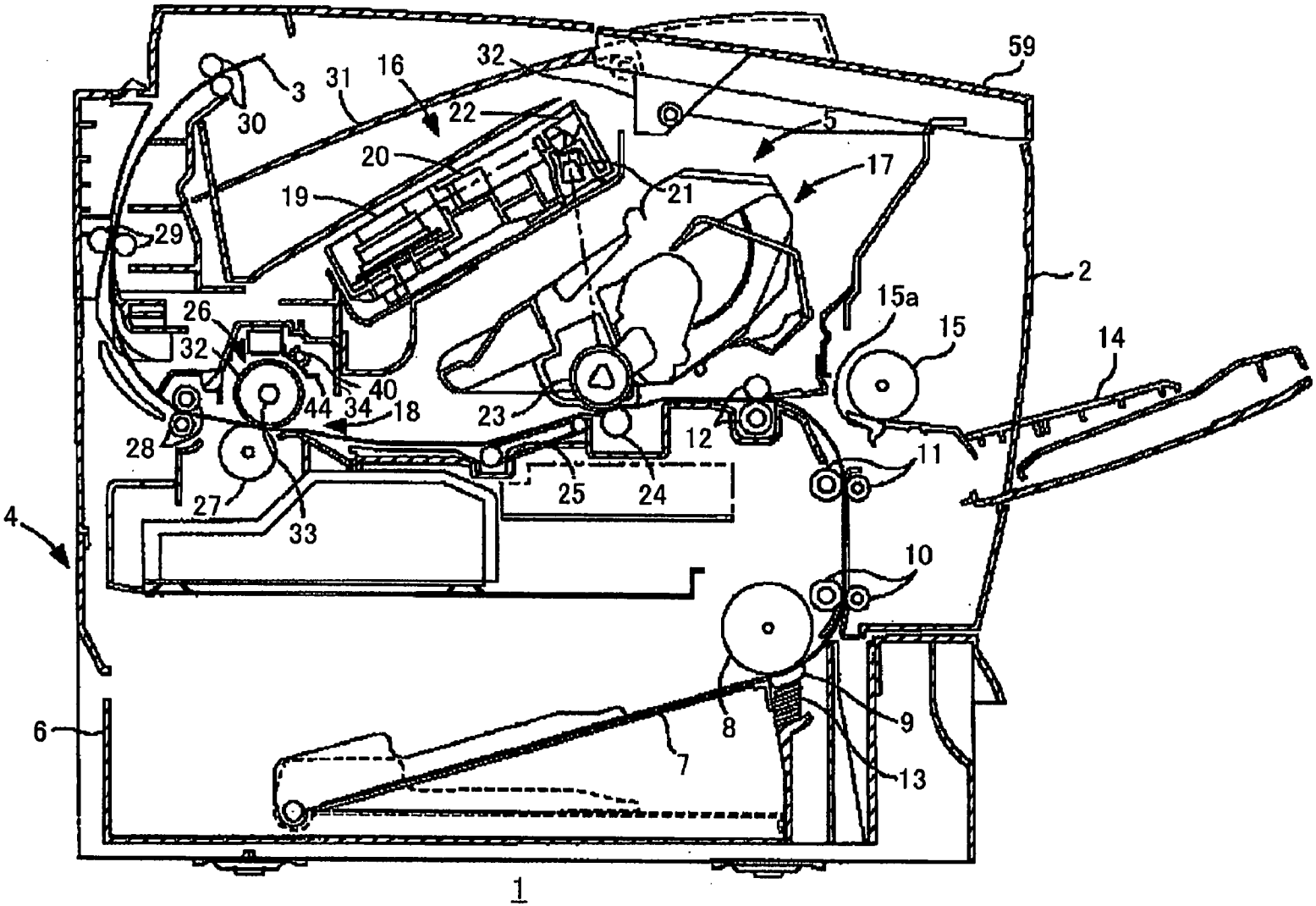
FIG. 1 is a side cross-sectional view showing a laser printer according to the present invention.

Next, an image-forming device according to a preferred embodiment of the present invention will be described with reference to the accompanying drawings. Referring to FIG. 1, a laser printer 1 includes a feeding unit 4 for feeding sheets 3 of paper, an image-forming unit 5 for forming images on the sheets 3 supplied from the feeding unit 4, and a controller 100 (not shown) for controlling the feeding unit 4 and image-forming unit 5, within a main casing 2. The image-forming unit 5 includes a scanning unit 16, a process cartridge 17, a transfer roller 24, and a heat fixing device 18.

The feeding unit 4 is disposed in the bottom section of the main casing 2 and includes a paper tray 6 detachably loaded in the feeding unit 4, a paper pressing plate 7 disposed in the paper tray 6, a feeding roller 8 and a separating pad 9 disposed above one end of the paper tray 6, a pair of conveying rollers 10 and a pair of conveying rollers 11 disposed downstream of the feeding roller 8 with respect to the direction in which the sheets 3 is conveyed (hereinafter, upstream or downstream in the conveying direction of the sheets 3 will be abbreviated simply as "upstream" or "downstream"), and registration rollers 12 provided downstream of the conveying rollers 10 and 11.

The sheets 3 can be stacked on the paper pressing plate 7. The paper pressing plate 7 is pivotably supported on the end farthest from the feeding roller 8, enabling the end nearest the feeding roller 8 to move vertically. A spring (not shown) is disposed on the underside of the paper pressing plate 7, urging the paper pressing plate 7 upward. As the number of sheets 3 stacked on the paper pressing plate 7 increases, the paper pressing plate 7 opposes the urging force of the spring and pivots downward about the supporting point on the end farthest from the feeding roller 8. The feeding roller 8 and separating pad 9 are disposed in confrontation with each other. A spring 13 disposed on the underside of the separating pad 9 presses the separating pad 9 against the feeding roller 8.

The topmost sheet 3 stacked on the paper pressing plate 7 is pressed against the feeding roller 8 by the spring (not shown) disposed on the underside of the paper pressing plate 7. The rotation of the feeding roller 8 interposes the topmost sheet 3 between the feeding roller 8 and separating pad 9 and subsequently feeds one sheet at a time. The conveying rollers 10 and 11 receive this sheet 3 and convey the sheet 3 to the registration rollers 12. After adjusting the sheet 3 to a prescribed register position, the registration rollers 12 convey the sheet to the image-forming unit 5.

The feeding unit 4 further includes a multipurpose tray 14 on which sheets 3 are stacked, and a multipurpose feeding roller 15 and a multipurpose separating pad 15*a* for feeding the sheets 3 stacked on the multipurpose tray 14. The multipurpose feeding roller 15 and the multipurpose separating pad 15*a* are disposed in opposition to each other. A spring (not shown) disposed on the underside of the multipurpose separating pad 15*a* presses the multipurpose separating pad 15*a* against the multipurpose feeding roller 15. The rotation of the multipurpose feeding roller 15 causes the topmost sheet 3 stacked on the multipurpose tray 14 to become interposed between the multipurpose feeding roller 15 and multipurpose separating pad 15*a* so that the sheets 3 are fed one sheet at a time.

The scanning unit 16 is disposed in an upper section of the main casing 2 and includes a laser light-emitting unit (not shown), a polygon mirror 19 that is driven to rotate, lenses 20 and 21, and a reflecting mirror 22. A laser beam emitted from the laser light-emitting unit based on prescribed image data passes through or is reflected by the polygon mirror 19, lens 20, reflecting mirror 22, and lens 21 in sequence, as indicated by the dotted line in FIG. 1, and is irradiated in a high-speed scan across the surface of a photosensitive drum 23 in the process cartridge 17 described later.

The process cartridge 17 is disposed below the scanning unit 16 and is detachably mounted in the main casing 2. The process cartridge 17 is provided with a photosensitive drum 23, as well as a Scorotron charger, a developing roller, and a toner accommodating unit (not shown).

The toner accommodating unit is filled with a positively charged, non-magnetic, single-component polymerized toner. This toner is carried on the surface of the developing roller as a thin layer having a uniform thickness. The photosensitive drum 23 is provided so as to rotate in contact with the developing roller. The photosensitive drum 23 is configured of a main body that is grounded, and a surface that includes a positively charged photosensitive layer formed of polycarbonates.

As the photosensitive drum 23 rotates, the Scorotron charger forms a uniform positive charge across the surface of the photosensitive drum 23, after which the charged surface is exposed to a high-speed scan of a laser beam emitted from the scanning unit 16, resulting in the formation of electrostatic latent images on the surface of the photosensitive drum 23 based on prescribed image data. Next, the positively charged toner carried on the surface of the developing roller is brought into contact with the photosensitive drum 23 as the developing roller and photosensitive drum 23 rotate. At this time, latent images formed on the surface of the photosensitive drum 23 are transformed into visible images when the toner is selectively attracted to portions of the photosensitive drum 23 that were exposed to the laser beam and, therefore, have a lower potential than the rest of the surface having a uniform positive charge. In this way, a toner image is formed.

The transfer roller 24 is disposed below the photosensitive drum 23 and is rotatably supported in the main casing 2 in opposition to the photosensitive drum 23. The transfer roller 24 includes a metal roller shaft covered by a roller that is formed of an electrically conductive rubber material. During a transfer process, a prescribed transfer bias is applied between the transfer roller 24 and photosensitive drum 23. As a result, the visible toner image carried on the surface of the photosensitive drum 23 is transferred onto the sheet 3, as the sheet 3 passes between the photosensitive drum 23 and transfer roller 24. After the visible image has been transferred, the sheet 3 is conveyed to the heat fixing device 18 by a conveying belt 25.

The heat fixing device 18 is disposed downstream of the process cartridge 17 when the process cartridge 17 is mounted in the main casing 2. The heat fixing device 18 includes a heat roller 26 provided with a fixing heater 33, and a pressure roller 27 disposed in confrontation with the heat roller 26 such that the sheet 3 can be interposed between the heat roller 26 and pressure roller 27. After toner is transferred onto the sheet 3 in the process cartridge 17, the toner is fixed to the sheet 3 by heat in the heat fixing device 18, as the sheet 3 passes between the heat roller 26 and pressure roller 27.

Generally, the heater 33 is maintained at a certain temperature within a predetermined temperature range having an upper limit.

Pairs of conveying rollers 28 and 29 and discharge rollers 30 are disposed downstream of the heat fixing device 18 in the order given. After an image has been fixed on the sheet 3 in the heat fixing device 18, the conveying rollers 28 and 29 convey the sheet 3 to the discharge rollers 30, and the discharge rollers 30 discharge the sheet 3 onto a discharge tray 31 provided on top of the main casing 2.

The controller 100 includes a CPU 61 (See FIG. 5), a storage (not shown) for saving programs for the laser printer 1.

Figure 2:
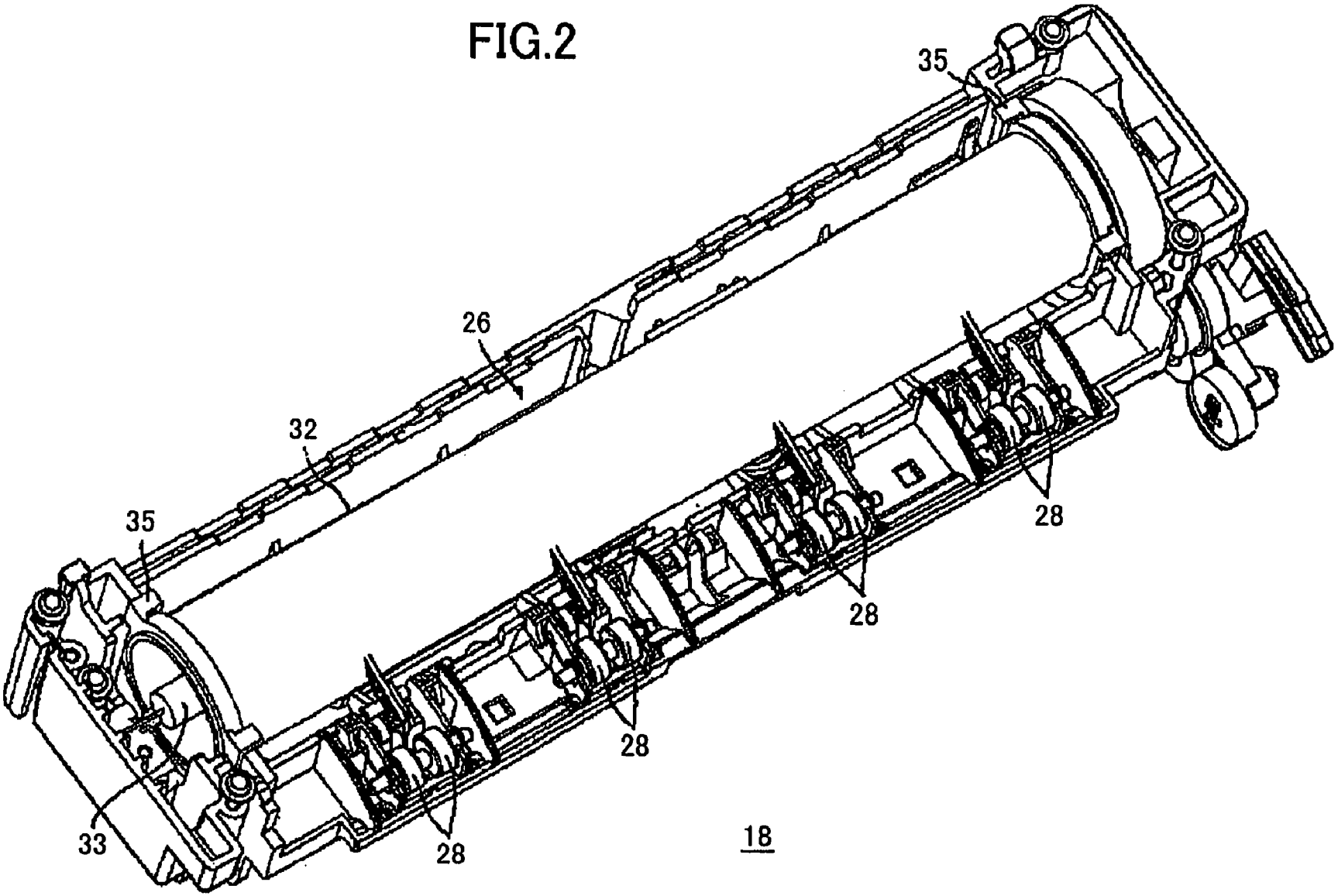
FIG. 2 is a perspective view showing a casing member for a heat fixing device.

The next description will be made for explaining the details of the heat fixing device 18. Referring to FIG. 2, the heat roller 26 in the heat fixing device 18 includes a metal roller body 32, and a heater 33 accommodated in the metal roller body 32 and extending along the axis of the same. The heat roller 26 is rotatably supported in a casing member 34 of the main casing 2. As shown in FIG. 1, the casing member 34 is formed on the inside of the main casing 2, covering the heat roller 26. The casing member 34 extends in the axial direction of the heat roller 26 and has a cross section shaped as a square open on the bottom. Referring to FIG. 2 again, holding units 35 are formed on both longitudinal ends of the casing member 34 for supporting the metal roller body 32. The conveying rollers 28 are also rotatably supported in the casing member 34.

The metal roller body 32 has a cylindrical shape. When accommodated in the casing member 34, the metal roller body 32 is rotatably supported on both axial ends by the holding units 35. The heater 33 is accommodated in the center of the metal roller body 32 and extends along the axis of the same with substantially the same length as the metal roller body 32.

The heat fixing device 18 includes a safety mechanism to protect the heater 33 from overheating. If the heater 33 reaches an excess temperature due to some unexpected reasons, the laser printer 1 quits feeding the heater 33.

Figure 3:
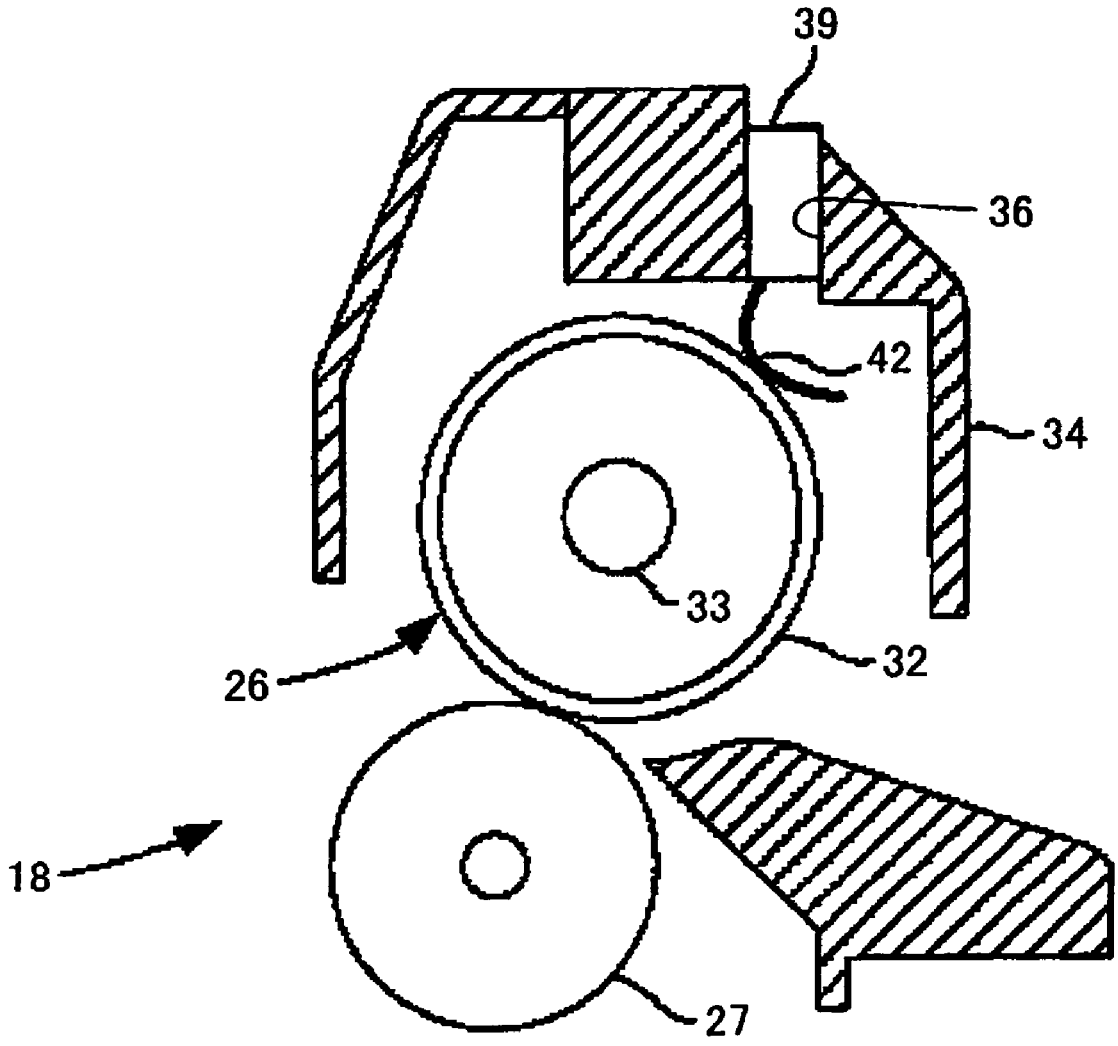
FIG. 3 is a side cross-sectional view illustrating a thermistor region of the heat fixing device.
Figure 4:
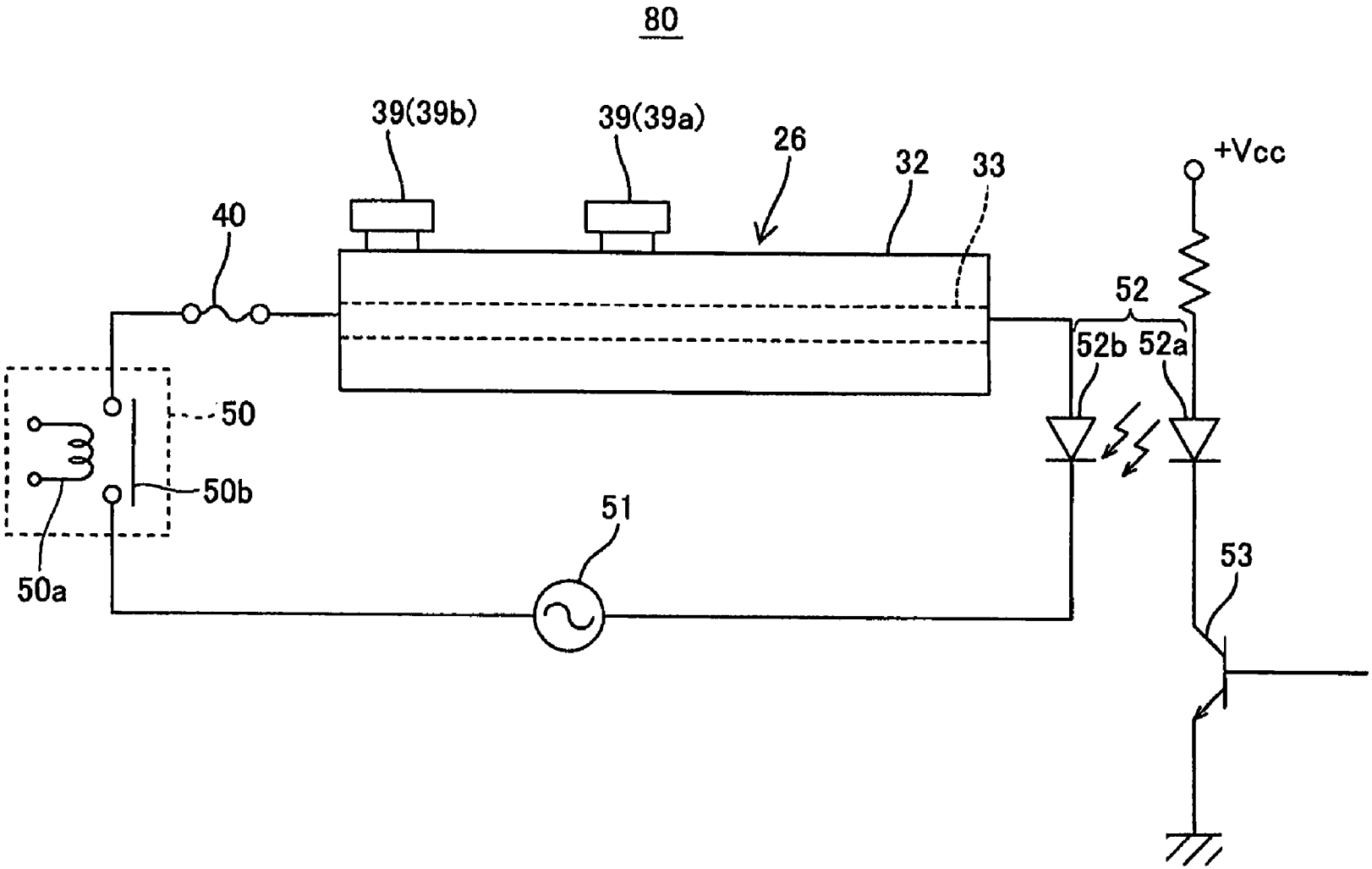
FIG. 4 is a circuit diagram showing an energizing circuit.

The casing member 34 described above accommodates a pair of thermistors 39 disposed near the metal roller body 32 of the heat roller 26 for detecting a temperature of the roller 32 (See FIG. 3), and a temperature fuse 40 (See FIG. 1). As shown in FIG. 3, each of the thermistors 39 includes a temperature detecting unit 42. The thermistors 39 are mounted in a thermistor mounting section 36 of the casing member 34 so that the temperature detecting units 42 is in contact with the surface of the metal roller body 32. As shown in FIG. 4, one of the thermistors 39 contacts the surface of the metal roller body 32 at the axial center of the same. Hereinafter, the thermistor disposed at this center position will be referred to as a center thermistor 39*a*. The other thermistor 39 contacts the surface of the metal roller body 32 near an axial end of the same and in a position that is not contacted by the conveyed sheet 3. Hereinafter, the thermistor disposed near the axial end of the metal roller body 32 will be referred to as an edge thermistor 39*b*.

As shown in FIG. 1, a fuse cover 44 is attached to the temperature fuse 40 between the temperature fuse 40 and the metal roller body 32. The fuse cover 44 is formed of an electrically insulating synthetic resin material. The fuse cover 44 is formed integrally with a heat collecting plate formed of a bowed rectangular plate having a curvature that follows the surface of the metal roller body 32, and a pinching member for gripping the temperature fuse 40. With the pinching member of the fuse cover 44 gripping a synthetic resin part of the temperature fuse 40 formed, the heat collecting plate is disposed between the temperature fuse 40 and metal roller body 32 for covering the temperature fuse 40.

The heat fixing device 18 further includes an energizing circuit 80 for providing power to the heater 33 and a heater controller 60 to control the operation of the heater 33 under the control of the controller 100.

Referring to FIG. 4, the energizing circuit 80 includes the heater 33, the temperature fuse 40, a relay unit 50, a power supply 51, and a photocoupler 52. The temperature fuse 40, the relay unit 50, and the photocoupler 52 are connected to the heater 33 in series.

The relay unit 50 includes a relay contact 50*b* and a relay coil 50*a* to switch on and off the relay contact 50*b* by the energiz. The relay contact 50*b* is close when the relay coil 50*a* is energized. The relay contact 50*b* is open when the relay coil 50*a* is not energized.

The photocoupler 52 has a light-emitting element 52*a* such as a light-emitting diode, and a light-receiving element 52*b* such as a photodiode or a phototransistor. The light-emitting diode 52*a* is connected between a power source line Vcc and an emitter of a transistor 53 provided in the heater controller 60. When the transistor 53 is turned on, the light-emitting element 52*a* emits a light beam and the light-receiving element 52*b* detects the light beam. While the light-receiving element 52*b* detects the light beam, the light-receiving element 52*b* is rendered electrically conductive.

With the above structure of the energizing circuit 80, the circuit including the heater 33 and the power supply 51 is closed, when the transistor 53 is turned on and the relay contact 50*b* is close. Under these conditions, the heater 33 is energized to generate heat.

When the transistor 53 is turned off, the light-emitting element 52*a* does not emit a light beam, so that the light-receiving element 52*b* is maintained at a non-electrical conductive condition. On the other hand, when the relay coil 50*a* is not energized, the relay contact 50*b* is open, so that the heater 33 is not energized.

The temperature fuse 40 interrupts a current to the heater 33 in order to prevent the heater 33 from overheating in case the heater controller 60 no longer takes control over the heater 33 due to the malfunction.

Figure 5:
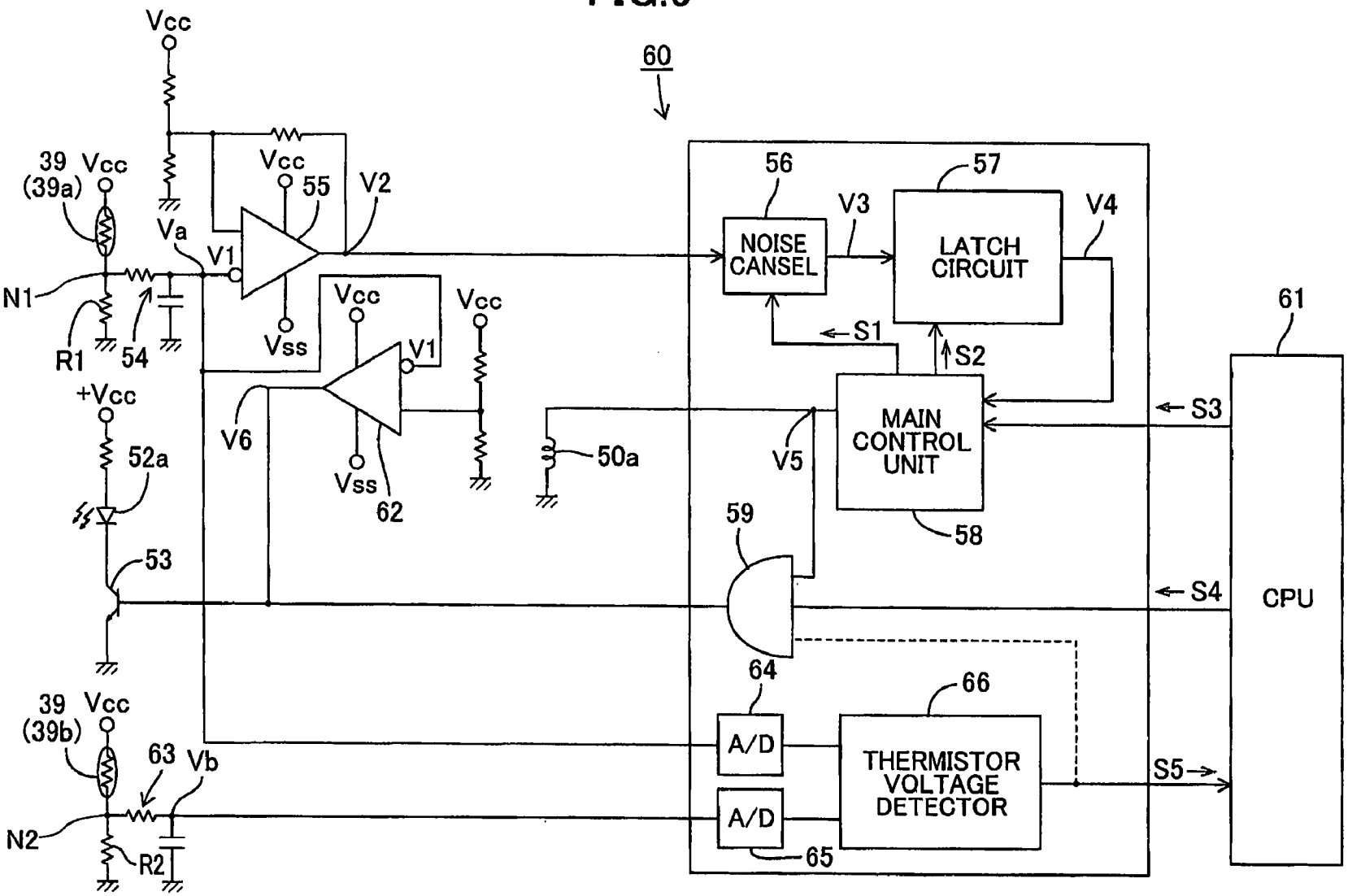
FIG. 5 is a circuit diagram showing a heater control circuit.

Referring to FIG. 5, the detail of the heater controller 60 will be described. The heater controller 60 includes a comparator 55, a noise canceling circuit 56, a latch circuit 57, and a main control unit 58. The heater controller 60 monitors the temperature of the roller 32 by the thermistor 39*a*, and controls the operations of the heater 33 by the relay unit 50 and the photocoupler 52.

The center thermistor 39*a* has one end connected to the power source line Vcc, and the other end grounded via a resistor R1. An integrator circuit 54 is provided to integrate the voltage appearing at a node N1 between the center thermistor 39*a* and the resistor R1 and then produce an output voltage Va. The output terminal of the integrator circuit 54 is connected to a reversed input terminal of the comparator 55. In other words, the output voltage Va is inverted and supplied to the comparator 55 as a voltage level V1 (V1=−Va). Thus, the voltage level V1 received by the comparator 55 corresponds to the detected temperature of the roller 32.

The comparator 55 determines whether the temperature of the center position of the roller 32 exceeds an abnormal temperature. The comparator 55 exhibits hysteresis characteristics. An output level V2 of the comparator 55 becomes a LOW level when the voltage level V1 increases and then exceeds a first threshold X. The output level V2 of the comparator 55 switches a HIGH level, when the voltage level V1 decreases and then drops below a second threshold Y after exceeding the first threshold X. It is noted that the first threshold X is larger than the second threshold Y. The first and second threshold X and Y are received at a non-inverted input terminal of the comparator 55.

The first threshold X corresponds to the voltage level V1 when the detected temperature of the roller 32 reaches the abnormal temperature. The second threshold Y is smaller than the first threshold X, and corresponds to another voltage level V1 when the detected temperature of the roller 32 is lower than the abnormal temperature by a predetermined temperature. The time period from when the voltage level V1 exceeds the first threshold to when the voltage level V1 falls below the second threshold is the time period in which the heater 33 is considered to be overheated.

The comparator 55 generates an output voltage V2. The output terminal of the comparator 55 is connected to the noise canceling circuit 56. The noise canceling circuit 56 receives the output voltage V2 to generate an output voltage V3. The output terminal of the noise canceling circuit 56 is connected to the latch circuit 57. The latch circuit 57 receives the output voltage V3 and generate an output voltage V4. The output terminal of the latch circuit 57 is connected to the main control unit 58. The main control unit 58 receives the voltage V4.

The noise canceling circuit 56 detects the level of the output level V2 of the comparator 55 at a detecting timing occurred at prescribed cycle of T. In this embodiment, the noise canceling circuit 56 detects the level of the output level V2 at time intervals of 100 ms. The noise canceling circuit 56 outputs a HIGH output level V3 when detecting that the voltage V2 is at a HIGH level, that is, when the comparator 55 determines that the temperature of the roller 32 detected by the center thermistor 39*a* is less than the abnormal temperature.

When the voltage V2 is at the LOW level, that is, when the comparator 55 determines that the detected temperature of the roller 32 exceeds the abnormal temperature, the noise canceling circuit 56 starts counting the number of continuous timings on which the comparator 55 determines that the detected temperature of the roller 32 exceeds the abnormal temperature, while detecting the output level V2 from the comparator 55 at the prescribed time intervals the number of the continuous timings on which the output level V2 is at the LOW level reaches a prescribed number (in this embodiment, three), the noise canceling circuit 56 inverts the output level V3 to the LOW level, indicating an abnormal signal.

On the other hand, the number of continuous timings on which the output level V2 is at the LOW level is less than the prescribed number, three, the noise canceling circuit 56 maintains the output level V3 at the HIGH level.

When the output level V3 from the noise canceling circuit 56 is at the HIGH level, the latch circuit 57 supplies an output level V4 having a HIGH level to the main control unit 58. When the main control unit 58 receives the HIGH output level V4 from the latch circuit 57, the main control unit 58 generates an output level V5 having a HIGH level. The output level V5 of the main control unit 58 is applied to an AND circuit 59 and the relay coil 50*a* in the relay unit 50.

When the output level V5 of the main control unit 58 is at the HIGH level, the relay coil 50*a* generates a magnetic force due to the HIGH level voltage, thereby closing the relay contact 50*b*. The AND circuit 59 generates a HIGH level signal to a base of the transistor 53, provided that the AND circuit 59 receives a heater driving signal S4 having a high level from the CPU 61. The HIGH level signal from the AND circuit 59 turns on the transistor 53, causing the light-emitting element 52*a* to emit a light beam. The light-receiving element 52*b* receives the light beam from the light-emitting element 52*a*, thereby becoming electrically conductive.

As described above, when the voltage level V5 is at the HIGH level, the circuit including the power supply 51 and the heater 33 is closed, thereby energizing the heater 33 to heat the roller 32.

When the output level V3 of the noise canceling circuit 56 is changed to the LOW level, the latch circuit 57 latches (holds) the LOW level and then supplies the LOW output level V4 to the control circuit 58.

When the main control unit 58 receives the LOW output level V4 from the latch circuit 57, the main control unit 58 inverts the voltage V5 to a LOW level, thereby turning off the relay contact 50*b* and rendering the light-receiving element 52*b* non-conductive. Thus, power supply to the heater 33 is suspended, that is, the heater 33 is turned off.

Figure 6:
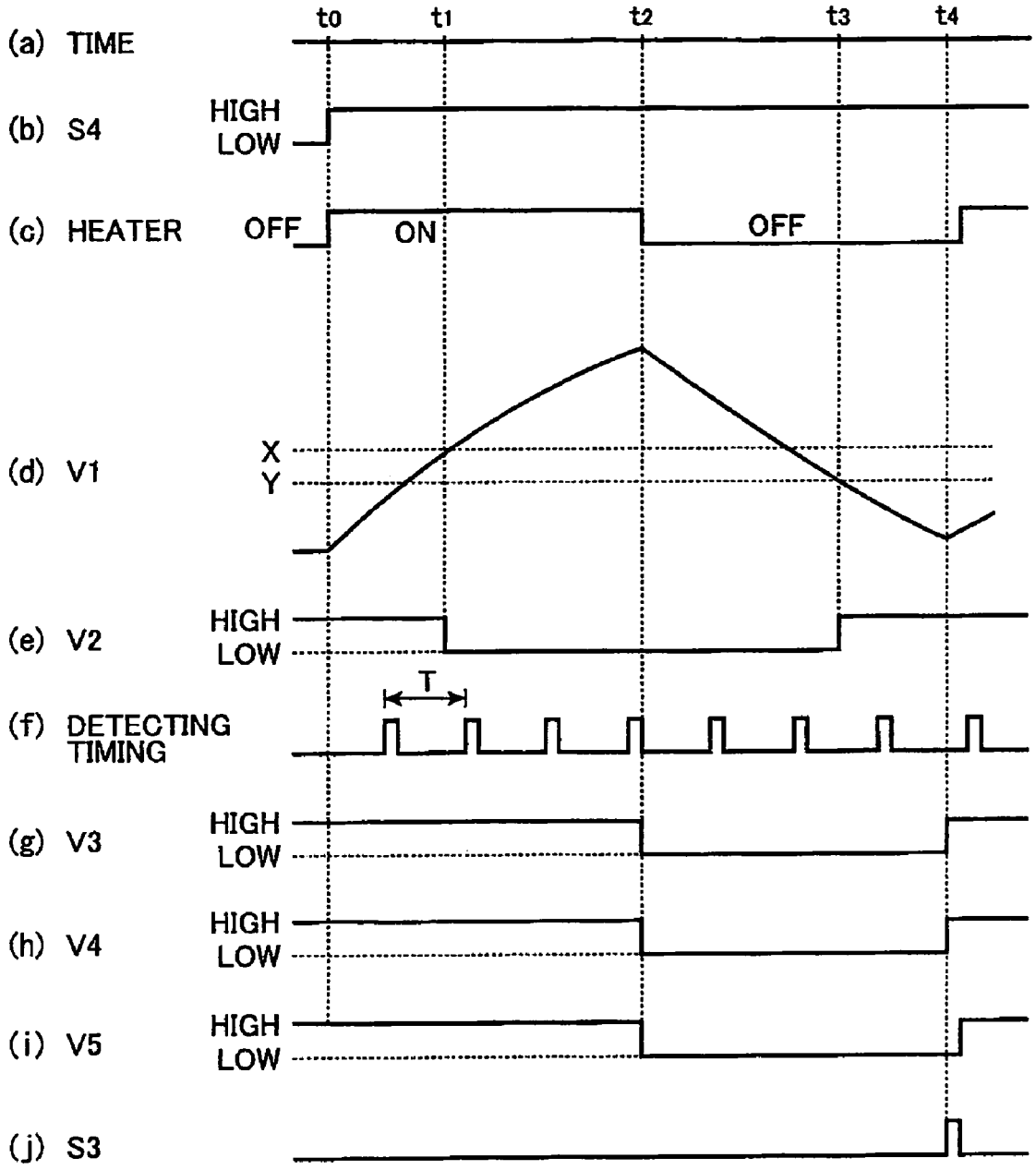
FIG. 6 is a wave form chart of the heater control circuit.

The next description will be made for explaining the operation of the heater controller 60. Referring to FIG. 6, at the time t0, the heater 33 is turned on in response to the heater drive signal S4 from the CPU 61 (see FIG. 6(*b*)). At the time t0, the temperature of the roller 32 is less than the abnormal temperature so that the output level V5 is at the HIGH level (see FIG. 6(*i*)). Accordingly, in response to the heater drive signal S4, the heater controller 60 closes the relay contact 50*b* and renders the light-receiving element 52*b* electrically conductive. Therefore, the heater 33 is energized to heat the roller 32 (see FIG. 6(*c*)).

At the time t1, when the voltage level V1 exceeds the threshold X, the output level V2 is switched to the LOW level (see FIGS. 6(*d*) and 6(*e*)). When the voltage V2 is at the LOW level, the noise canceling circuit 56 starts counting the number of continuous timings on which the comparator 55 determines that the detected temperature of the roller 32 exceeds the abnormal temperature (see FIG. 6(*f*)).

When the number of the continuous timings reaches three (3) at the time t2, the noise canceling circuit 56 inverts the output level V3 to the LOW level (see FIG. 6(*g*)) The latch circuit 57 then latches the LOW level and then supplies the LOW output level V4 to the control circuit 58 (see FIG. 6(*h*)). In response to the LOW output level V4 from the latch circuit 57, the main control unit 58 inverts the voltage V5 to a LOW level (see FIG. 6(*i*)), which opens the relay contact 50*b* and rendered the light-receiving element 52*b* rendered non-conductive. Accordingly, the heater 33 is turned off at the time t2 (see FIG. 6(*c*)).

Alternatively, the main control unit 58 can generate and supply reset signals S1 and S2 to the noise canceling circuit 56 and the latch circuit 57, respectively, when receiving the LOW output level V4 from the latch circuit 57 for the first time, for example. It should be noted that the main control unit 58 can generate the reset signals S1 and S2 depending on an instruction from the CPU 61.

Figure 7:
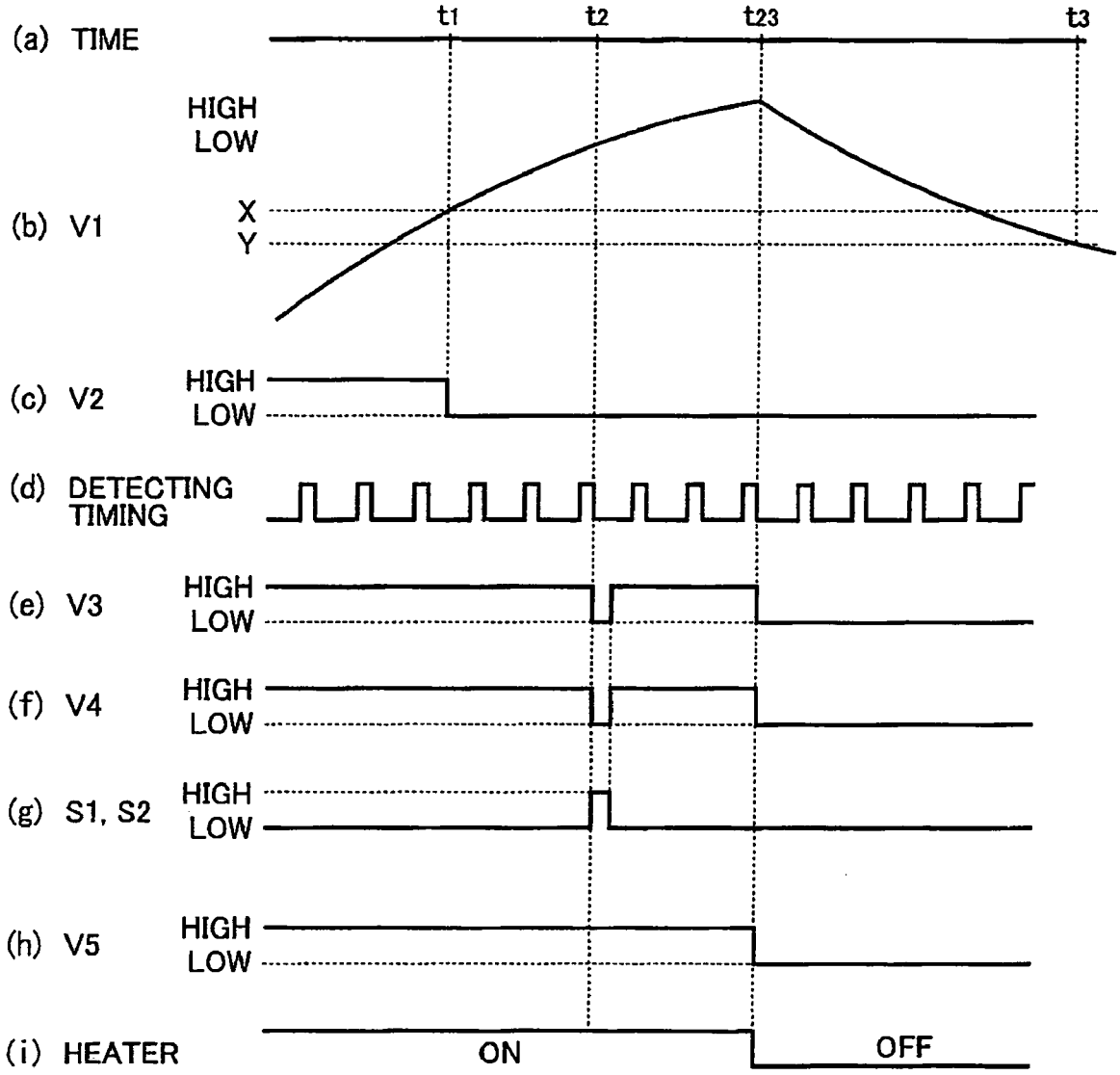
FIG. 7 is a wave form chart of a modification of the heater control circuit.

In response to the reset signal S1, the noise canceling circuit 56 returns the LOW output level V3 to the HIGH level, and initializes the number of the continuous timing on which the output level V2 is determined to be at the LOW level by the detecting timing (see FIG. 7(*e*)). In response to the reset signal S2, the latch circuit 57 returns the LOW output level V4 to the HIGH level (see FIG. 7(*f*)). When the main control unit 58 generates the reset signals S1 and S2, the main control unit 58 maintains the output level V5 at the HIGH level (see FIG. 7(*h*)).

Referring to FIG. 7, when the number of the continuous timings reaches three (3) at the time t2, the noise canceling circuit 56 inverts the output level V3 to the LOW level (See FIG. 7(*e*)). The latch circuit 57 then latches the LOW level and then supplies the LOW output level V4 to the control circuit 58 (See FIG. 7(*f*)). In response to the LOW output level V4 from the latch circuit 57, the main control unit 58 generates the reset signals S1 and S2 to the noise canceling circuit 56 and the latch circuit 57 at the time t12, respectively (See FIG. 7(*g*)). Therefore, the output levels V3 and V4 return to the HIGH level and the number of continuous timings is reset to zero (See FIGS. 7(*e*) and 7(*f*)), while the main control unit 58 maintains generating the HIGH output level V5 (See FIG. 7(*f*)). In other words, heater 33 is maintained on at the time t2 (See FIG. 7(*i*)).

The noise canceling circuit 56 continues determining the temperature of the roller 32, i.e., if the output level V2 is still at the LOW level. At the time t23, the number of the continuous timing after the time t2 again reaches three (3), the noise canceling circuit 56 inverts the output level V3 to the LOW level (See FIG. 7(*e*)). At this time t23, the latch circuit 57 latches the LOW level and supplies the LOW output level V4 to the control circuit 58.

When the main control unit 58 receives the LOW output level V4 from the latch circuit 57 twice at the time t23, the main control unit 58 inverts the HIGH output level V5 to the LOW level (See FIG. 7(*h*)). Due to the LOW output level V5, the relay contact 50*b* is opened, because magnetic force to close the relay contact 50*b* is not generated by the relay coil 50*a*. Simultaneously, the AND circuit 59 supplies the LOW level signal to the base of the transistor 53. Therefore, the transistor 53 is turned off, so that light-emitting element 52*a* does not emit a light beam. The light-receiving element 52*b* then does not detect any light beam from light-emitting element 52*a*, thereby becoming non-electrically conductive. Thus, power supply to the heater 33 is suspended so that the heater 33 is turned off (See FIG. 7(*i*)).

In this case, the reset signals S1 and S2 are generated when the latch circuit 57 inverts the output level V4 into the LOW level. In another embodiment, when the output level V4 is inverted to the LOW level for the second time after the time t1, i.e., at the time t23, the reset signals S1 and S2 can be generated again.

The number of generation of the reset signals S1 and S2 depend on the stability of the voltage level V1 corresponding to the detected temperature of the roller 32 by the center thermistor 39*a*. If the voltage level V1 readily and stably corresponds to the detected temperature of the roller 32, the generation of the reset signals S1 and S2 can be eliminated as shown in FIG. 6.

On the other hand, if the voltage level V1 is unstable and does not correspond to the detected temperature of the roller 32 in a proper manner, the number of the generation of the reset signals S1 and S2 should be increased before the output level V5 from the main control unit 58 is inverted to the LOW level. The output level V5 of the main control unit 58 is maintained at the HIGH level until the detected temperature of the roller 32 is determined to be more than the abnormal temperature with reliability. Therefore, unnecessary turning off the heater 33 can be avoided while the laser printer 1 is operating.

The heat fixing device 18 is controlled in the manner described above. Accordingly, the temperature anomalies of the roller 32 is readily and stably detected, even when the voltage level V1 and the output level V2 are unstable due to noise.

Referring to FIG. 6 again, after the time t2, the voltage level V1 started decreasing because the heater 33 is turned off. At the time t3, when the voltage level V1 breaks the second threshold Y, the output level V2 is switched to the HIGH level (see FIG. 6(*e*)).

Referring to FIGS. 5 and 6 again, the main control unit 58 generates and supplies the reset signals S1 an S2 to the noise canceling circuit 56 and the latch circuit 57, respectively, when the main control unit 58 receives a reset instruction signal S3 from the CPU 61 at the time t4 (see FIG. 6(*j*)). The noise canceling circuit 56 and the latch circuit 57 change the output levels V3 and V4 to the HIGH levels, when receiving the reset signals S1 and S2. The reset instruction signal S3 is generated from the CPU 61 when a user operates a switch (not shown) on the laser printer 1.

If the output level V2 of the comparator 55 is at the HIGH level at the time t4, i.e., at the moment the reset instruction signal S3 is generated from the CPU 61, the output levels V3 and V3 changed to the HIGH level in response to the reset instruction signal S3 remain at the HIGH level, provided that the detected temperature of the roller 32 is less than the abnormal temperature. Therefore, the output level V5 of the main control unit 58 is changed to the HIGH level.

Accordingly, the relay coil 50*a* generates a magnetic force to close the relay contact 50*b* and render the transistor 53 on. The heater 33 is then energized to restart heating the roller 32 (see FIG. 6(*c*)).

It should be noted that the reset instruction signal S3 is generated as many times as a prescribed number (for example, once) after the heater 33 is turned off due to the temperature abnormalities. The resumption of the energization of the heater 33 by the user is invalid, when the heater 3.3 is turned off due to the temperature abnormalities after the reset instruction signal S3 resumes the heating of the roller 32. Therefore, the reset instruction signal S3 is not generated again.

Referring to FIG. 5 again, an immediate control circuit is also provided in the heater controller 60. In the operation of the heater controller 60 shown in FIG. 6, the energization of the heater 33 is not turned off until the number of detecting timings on which the output level V2 of the comparator 55 is determined to be at the LOW level reaches three (3). The above operation of the heater controller 60 is not enough to protect the heater 33 from damage when a rise in temperature is so rapid, which may result in critical damage to the laser printer 1.

Figure 8:
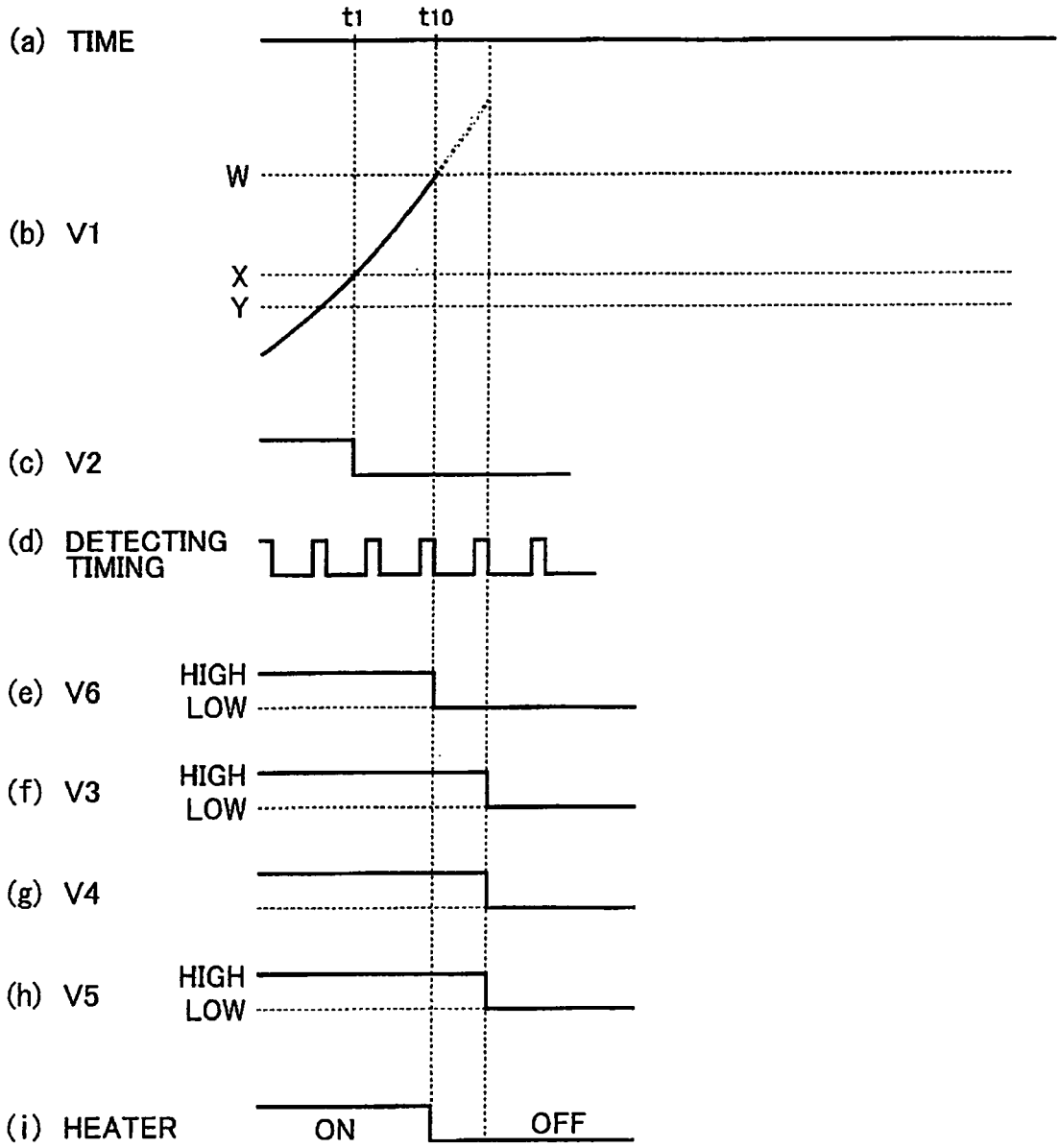
FIG. 8 is a wave form chart of the immediate control circuit.

The heater controller 60 includes a comparator 62 as shown in FIG. 5. The comparator 62 compares the voltage level V1, corresponding to the detected temperature of the roller 32 by the center thermistor 39*a*, with a third threshold W. The third threshold W corresponds to an emergency interrupting temperature which is higher than the abnormal temperature corresponding to the first threshold X. The comparator 62 generates a LOW output level V6 when the voltage level V1 is higher than the third threshold W at the time t10 (see FIG. 8(*e*)). The comparator 62 generates a HIGH output level V6 when the voltage level V1 is less than the third threshold W.

When the output level V6 of the comparator 62 is at the HIGH level, the HIGH output level V6 is applied to the base of the transistor 53, thereby turning on the transistor 53. On the other hand, when the output level V6 of the comparator 62 is at the LOW level, the LOW output level V6 is applied to the base of the transistor 53, thereby the turning off the transistor 53. Thus, the energization of the heater 33 is suspended when the output level V6 of the comparator 62 is at the LOW level regardless of the output level V5 of the main control unit 58 (see FIGS. 8(*h*) and 8(*i*)).

As described above, even when the rise in the temperature of the roller 32 is so rapid due to the abnormal heating of the heater 33, the energization of the heater 33 is suspended at the moment the detected temperature reaches the emergency interrupting temperature, which correspond to the third threshold W. As a result, critical damage to the laser printer 1 can be avoided.

In the preferred embodiment, as described above, the laser printer 1 is provided with the edge thermistor 39*b* for detecting the temperature at a region of the metal roller body 32 over which the sheet 3 does not pass, as well as the center thermistor 39*a* for detecting temperature at a center position of the metal roller body 32 where the sheet 3 passes. One end of the edge thermistor 39*b* is connected to the power source line Vcc, while the other end is grounded via a resistor R2. An integrator circuit 63 integrates the voltage appearing at a node N2 between the edge thermistor 39*b* and the resistor R2 to generate a voltage Vb. The voltage Va generated from the center thermistor 39*a* and the voltage Vb generated from the edge thermistor 39*b* are transferred into a thermistor voltage detecting circuit 66 via A/D converting circuits 64 and 65, respectively.

Figure 9A:
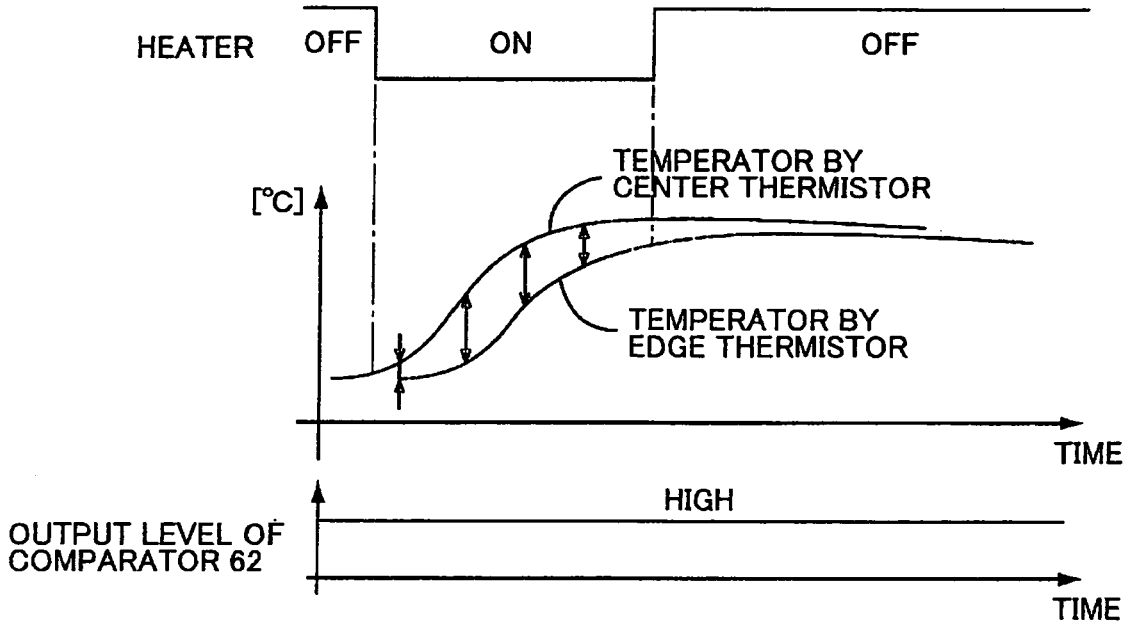
FIGS. 9A and 9B are graphs showing temperature changes for a pair of thermistors.
Figure 9B:
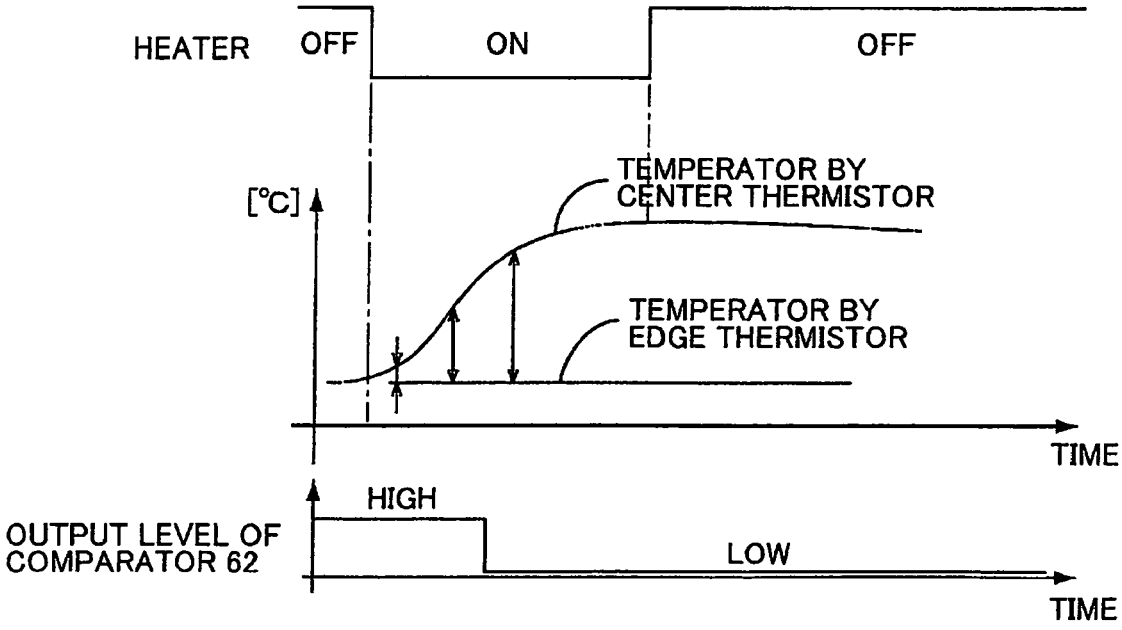

If both the thermistors 39 are operating normally while the heater 33 heats the roller 32, the difference in their temperatures should fall within a prescribed range (see FIG. 9A). However, if one of the thermistors 39*a* and 39*b* such as the edge thermistor 39*b* is failing or is in an otherwise abnormal state, the temperature difference between the thermistors 39*a* and 39*b* may exceed the prescribed range, as shown in FIG. 9B.

The thermistor voltage detecting circuit 66 determines whether the temperature difference between the thermistors 39*a* and 39*b* has exceeded this prescribed range based on the voltages Va and Vb. If the prescribed range has been exceeded, then the thermistor voltage detecting circuit 66 determines at least one of the thermistors is malfunctioning and issues a thermistor abnormality signal S5 to the CPU 61.

Upon receiving the thermistor abnormality signal S5, the CPU 61 halts transmission of the heater drive signal S4 to the AND circuit 59, that is, change the signal S4 to the LOW Level. Accordingly, the transistor 53 receives the LOW level signal at the base, thereby interrupting the energization of the heater 33.

As indicated by the dotted line in FIG. 5, the thermistor voltage detecting circuit 66 may be configured to apply a LOW level signal to the AND circuit 59 directly when the temperature difference between the thermistors 39*a* and 39*b* falls within the prescribed range, and to apply a HIGH level signal to the AND circuit 59 when the temperature difference exceeds the prescribed range. Accordingly, the energization of electricity to the heater 33 is halted when the thermistors 39*a* and 39*b* malfunction, without requiring the CPU 61 to perform a process in software.

The noise canceling circuit 56, latch circuit 57, main control circuit 58, AND circuit 59, A/D converting circuits 64 and 65, and thermistor voltage detecting circuit 66 may be configured by an Application-Specific Integrated Circuit (ASIC).

By controlling the heater 33 with a hardware construction including the energizing circuit with the transistor 53, the temperature detecting circuit with the thermistors 39*a* and 39*b*, the noise canceling circuit 56, and the main control unit 58, it is possible to avoid incorrect operations that can occur through software control. Further, the noise canceling circuit 56 can suppress the effects of noise.

The noise canceling circuit 56 is configured to apply a LOW level voltage V3 to the latch circuit 57 as an abnormality signal upon receiving a voltage V2 indicating an abnormal temperature a prescribed number of times in succession. This configuration prevents unstable control of the heater 33 that can occur when the laser printer 1 reacts every time the roller 32 momentarily exceeds the abnormal temperature. At the same time, if the temperature of the roller 32 exceeds the abnormal temperature continuously for a length of time considered to be problematic, the latch circuit 57 latches an abnormality signal indicating this abnormality and transmits this signal to the main control unit 58, and the main control unit 58 interrupts the energization of the heater 33. Accordingly, the heater control circuit 60 can effectively respond to abnormalities in the heater 33.

The control circuit 58 is configured both to reset the count value of the noise canceling circuit 56 and to release the latched state of the latch circuit 57. In this way, the heater control circuit 60 can perform more reliable control by latching an abnormal state when an abnormality signal is outputted from the noise canceling circuit 56, but also resetting the latched state after a prescribed number of periods T and latching the abnormal signal again when the noise canceling circuit 56 outputs an abnormality signal.

Further, because of the transistor 53 as the semiconductor switch and the relay circuit 50, the conducting circuit can maintain good response and reliability in controlling the energization of the heater 33.

However, the control performed with the noise canceling circuit 56, latch circuit 57, and control circuit 58 described above may not be able to follow sudden changes in temperature. Therefore, the laser printer 1 is also provided with an immediate control circuit having the comparator 62.

The thermistor voltage detecting circuit 66 is configured to interrupt the energization of the heater 33 when the difference in temperature between the two thermistors 39*a* and 39*b* exceeds a prescribed range. This configuration allows the laser printer 1 to halt the supply of electricity to the heater 33 when one of the thermistors malfunctions and cannot accurately measure the temperature of the metal roller body 32.

While the invention has been described in detail with reference to specific embodiments thereof, it would be apparent to those skilled in the art that many modifications and variations may be made therein without departing from the spirit of the invention, the scope of which is defined by the attached claims.

While the transistor 53 is used as the semiconductor switch in the above embodiment, the switch may be configured of a field-effect transistor.

In the first embodiment described above, the thermistor voltage detecting circuit 66 transmits a signal to the CPU 61 indicating temperature data detected by the thermistors 39. Here, the thermistor voltage detecting circuit 66 may be configured to identify a faulty thermistor when the temperature difference between the thermistors 39 exceeds a prescribed range by identifying the thermistor having the lowest temperature as the faulty thermistor. Alternatively, the thermistor voltage detecting circuit 66 can detect a slope of the change of temperatures between the two thermistors and identify the thermistor having the smallest slope as the faulty thermistor when the temperature difference exceeds the prescribed range.

Figure 10:
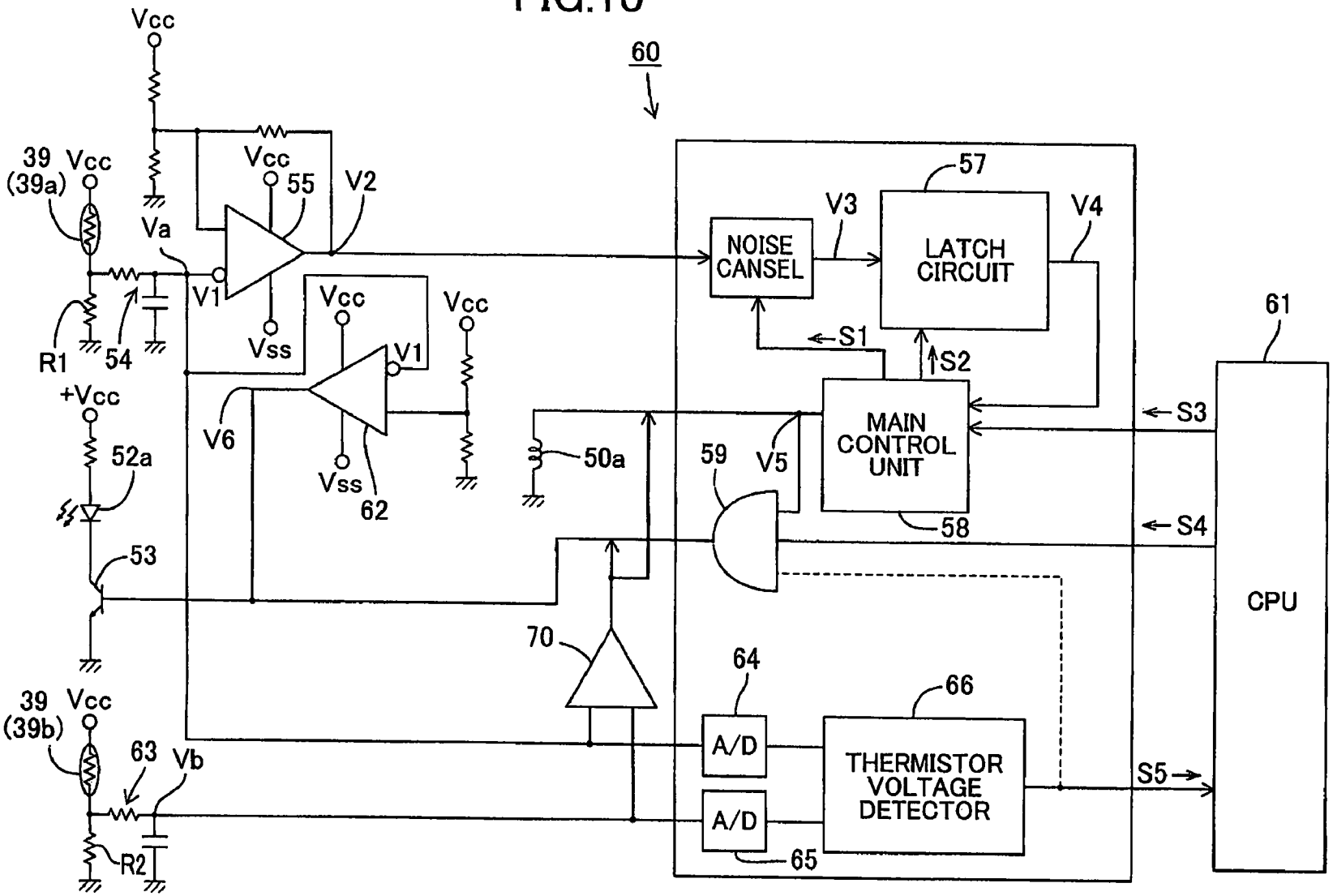
FIG. 10 is a circuit diagram showing a further modification of the heater control circuit according to the preferred embodiment.

FIG. 10 shows a variation of the above embodiment, wherein a comparator 70 is provided for outputting a signal corresponding to the difference between the voltages Va and Vb inputted from the thermistors 39. With this construction, the comparator 70 applies a HIGH level signal to the relay coil 50*a* of the relay circuit 50 and the base of the transistor 53 when the difference between the voltages Va and Vb falls within a prescribed range with a higher priority, and applies a LOW level signal that halts the energization of the heater 33 when the difference between the voltages Va and Vb exceeds this prescribed range.

The present invention is not limited to a laser printer or other printer described above, but includes facsimile devices, as well as multifunction devices that have a printer function, and a scanning function. Further, the recording medium to be printed includes transparency sheets as well as paper. The noise canceling unit 56 may include a filtering circuit.

What is claimed is:

1. An image-forming device comprising:

a fixing heater that heats a roller to fix a toner image transferred on a recording medium;

an energizing unit that energizes the fixing heater;

a temperature detecting unit that detects a temperature of the roller to generate a detection signal having a level corresponding to the detected temperature;

a noise canceling unit that eliminates a noise component from the detection signal to generate a resulting signal; and a control unit that generates a control signal for controlling the energizing unit, according to the resulting signal from the noise canceling unit.

2. The image-forming device according to claim 1, further comprising a latch unit provided between the noise canceling unit and the control unit, wherein the noise canceling unit detects the level of the detection signal at prescribed intervals, the noise canceling unit starts counting a number of timing at which the noise canceling unit continuously determines that the level of the detection signal exceeds a prescribed temperature level after the noise canceling unit determines for a first time that the level of the detection signal exceeds the prescribed temperature level, the noise canceling unit generates an abnormality signal when the number of timing reaches a prescribed number, the latch unit latches the abnormality signal and transfers the abnormality signal to the control unit upon receiving the abnormality signal from the noise canceling unit, and the control unit suspends the energization of the fixing heater on receiving the abnormality signal transferred from the latch unit.

3. The image-forming device according to claim 2, further comprising a reset unit that generates a reset signal to both the noise canceling unit and the latch unit, wherein, the noise canceling unit resets the counting the number of timing to zero in response to the reset signal, and the latch unit releases a latched state in response to the reset signal.

4. The image-forming device according to claim 1, wherein the energizing unit comprises a semiconductor switch that is turned on or off in response to the control signal, thereby controlling energization of the fixing heater.

5. The image-forming device according to claim 1, wherein the energizing unit comprises a mechanical relay unit that is opened or closed in response to the control signal, thereby controlling energization of the fixing heater.

6. The image-forming device according to claim 1, further comprising an immediate control unit that compares the level of the detection signal with a preset threshold value, and generates another resultant control signal for the energizing unit to determine energization of the energizing unit, based on a result of the comparison.

7. The image-forming device according to claim 1, wherein the temperature detecting unit detects a plurality of different positions of the fixing heater to generate a plurality of detection signals, each of the plurality of detection signals having a level corresponding to the detected temperature; further comprising a switching unit that switches on or off the energization of the energizing unit based on the levels of the plurality of detection signals.

8. An image-forming device comprising:

a fixing heater that heats a roller to fix a toner image transferred on a recording medium;

a temperature detecting unit that detects a temperature of the roller to generate a detection signal having a level corresponding to the detected temperature;

a noise canceling unit that determines at prescribed time-intervals if the level of the detection signal exceeds a prescribed level corresponding to an abnormal temperature level, the noise canceling unit starts counting a number of timing on which the level of the detection signal exceeds the prescribed level after the noise canceling unit determines for a first time that the level of the detection signal exceeds the prescribed level, the noise canceling unit generates an abnormality signal when the number of timing reaches a prescribed number;

a control unit that generates a control signal for controlling the fixing heater, the control unit suspends energization of the fixing heater when the noise canceling unit generates the abnormality signal.

9. The image-forming device according to claim 1, wherein the temperature detecting unit is electrically connected to the noise canceling unit.

* * * * *